US009327896B2

(12) United States Patent
Chiba et al.

(10) Patent No.: US 9,327,896 B2
(45) Date of Patent: May 3, 2016

(54) DISPENSING APPARATUS

(71) Applicant: ICOMES LAB Co., Ltd., Morioka-shi, Iwate (JP)

(72) Inventors: Hideshige Chiba, Iwate (JP); Tadataka Kamiyama, Iwate (JP)

(73) Assignee: ICOMES LAB CO., LTD., Iwate (JP)

( * ) Notice: Subject to any disclaimer, the term of this patent is extended or adjusted under 35 U.S.C. 154(b) by 0 days.

(21) Appl. No.: 14/171,057

(22) Filed: Feb. 3, 2014

(65) Prior Publication Data

US 2014/0332565 A1 Nov. 13, 2014

(30) Foreign Application Priority Data

May 13, 2013 (JP) ..... 2013-101585

(51) Int. Cl.
*B65D 88/54* (2006.01)
*B65D 83/00* (2006.01)
*B01L 3/02* (2006.01)

(52) U.S. Cl.
CPC ..... *B65D 83/0033* (2013.01); *B01L 3/0227* (2013.01); *B01L 2300/027* (2013.01)

(58) Field of Classification Search
CPC ..... B01L 3/021; B01L 3/0227; B01L 3/0237
USPC ..... 222/333; 73/864.16; 422/518, 521, 522
See application file for complete search history.

(56) References Cited

U.S. PATENT DOCUMENTS 4,298,575 A * 11/1981 Berglund ..... B01L 3/0227 222/309
5,343,769 A * 9/1994 Suovaniemi ..... B01L 3/0227 422/926
5,505,097 A 4/1996 Suovaniemi et al.
5,896,804 A * 4/1999 Kimura ..... B01L 3/0227 92/136
6,102,828 A * 8/2000 MacKenzie ..... E21B 33/0355 475/263
6,319,002 B1 * 11/2001 Pond ..... 433/89
6,540,964 B2 * 4/2003 Kohrmann ..... B01L 3/0279 422/501
2001/0055547 A1 12/2001 Rainin et al.
(Continued)

FOREIGN PATENT DOCUMENTS

JP 2006-015308 A 1/2006
JP 2006-349013 A 12/2006
JP 2007-187290 A 7/2007

OTHER PUBLICATIONS

Extended European Search Report issued in European Application No. 14153624.3-1361 dated Oct. 20, 2014.

*Primary Examiner* — Daniel R Shearer
(74) *Attorney, Agent, or Firm* — McDermott Will & Emery LLP

(57) ABSTRACT

A dispensing apparatus includes an output shaft having screw grooves on an outer circumferential surface, a rotary actuator including a reduction gear and configured to rotate the output shaft around an axis thereof, a piston screwed into the screw grooves and configured to move back and forth along an axial direction of the output shaft by drive of the rotary actuator, a nozzle disposed at a leading end of the dispensing apparatus and configured to suck and spout liquid along with the piston, and an actuator case configured to cover the reduction gear, and configured to support a proximal end portion of the output shaft by a leading end portion of the actuator case such that the proximal end portion of the output shaft is engaged with a leading end portion of the reduction gear in a state capable of transmitting the drive.

9 Claims, 11 Drawing Sheets

(56) References Cited

U.S. PATENT DOCUMENTS

2005/0247141 A1 11/2005 Belgardt et al.
2009/0018509 A1 1/2009 Takahashi et al.
2009/0158862 A1 6/2009 Londo et al.
2012/0136306 A1 5/2012 Bartha

* cited by examiner

DISPENSING APPARATUS

CROSS-REFERENCE TO RELATED APPLICATIONS

The present application claims priority to and incorporates by reference the entire contents of Japanese Patent Application No. 2013-101585 filed in Japan on May 13, 2013.

BACKGROUND OF THE INVENTION

1. Field of the Invention

The invention relates to a dispensing apparatus.

2. Description of the Related Art

Conventionally, there have been known dispensing apparatuses that cause a piston engaged with an output shaft to move back and forth along an axial direction of the output shaft, by rotating the output shaft around an axis by driving of a motor, thereby sucking and spouting liquid through a nozzle provided at a leading end.

In such dispensing apparatuses, the output shaft is connected to a motor serving as a drive source via a plurality of couplings or reduction gears (for example, see Japanese Laid-open Patent Publication No. 2006-15308).

However, in the technique suggested in Japanese Laid-open Patent Publication No. 2006-15308 described above, since power transmission is performed by interposing the plurality of couplings or reduction gears between the output shaft and the motor, there has been a risk of an excessive power loss generated until the power of the motor is transmitted to the output shaft or the piston. Furthermore, when the piston, the output shaft, and the plurality of couplings or reduction gears are disposed so as to be aligned on a rotary shaft of the motor, lengthening of the overall length of the dispensing apparatus itself is caused from large number of parts.

In view of the above circumstances, there is a need for a dispensing apparatus that is capable of improving the power transmission efficiency, and shortening the overall length of the entire apparatus.

SUMMARY OF THE INVENTION

It is an object of the present invention to at least partially solve the problems in the conventional technology.

According to one aspect of the present invention, there is provided a dispensing apparatus including: an output shaft having screw grooves on an outer circumferential surface; a rotary actuator including a reduction gear and configured to rotate the output shaft around an axis of the output shaft; a piston screwed into the screw grooves of the output shaft and configured to move back and forth along an axial direction of the output shaft by drive of the rotary actuator; a nozzle disposed at a leading end of the dispensing apparatus and configured to suck and spout liquid in accordance with the back and forth movement of the piston; and an actuator case configured to cover an outer circumferential portion of the reduction gear, and configured to support a proximal end portion of the output shaft by a leading end portion of the actuator case such that the proximal end portion of the output shaft is engaged with a leading end portion of the reduction gear in a state capable of transmitting the drive.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, preferred embodiments of a dispensing apparatus according to the invention will be described in detail with reference to the accompanying drawings.

Figure 1:
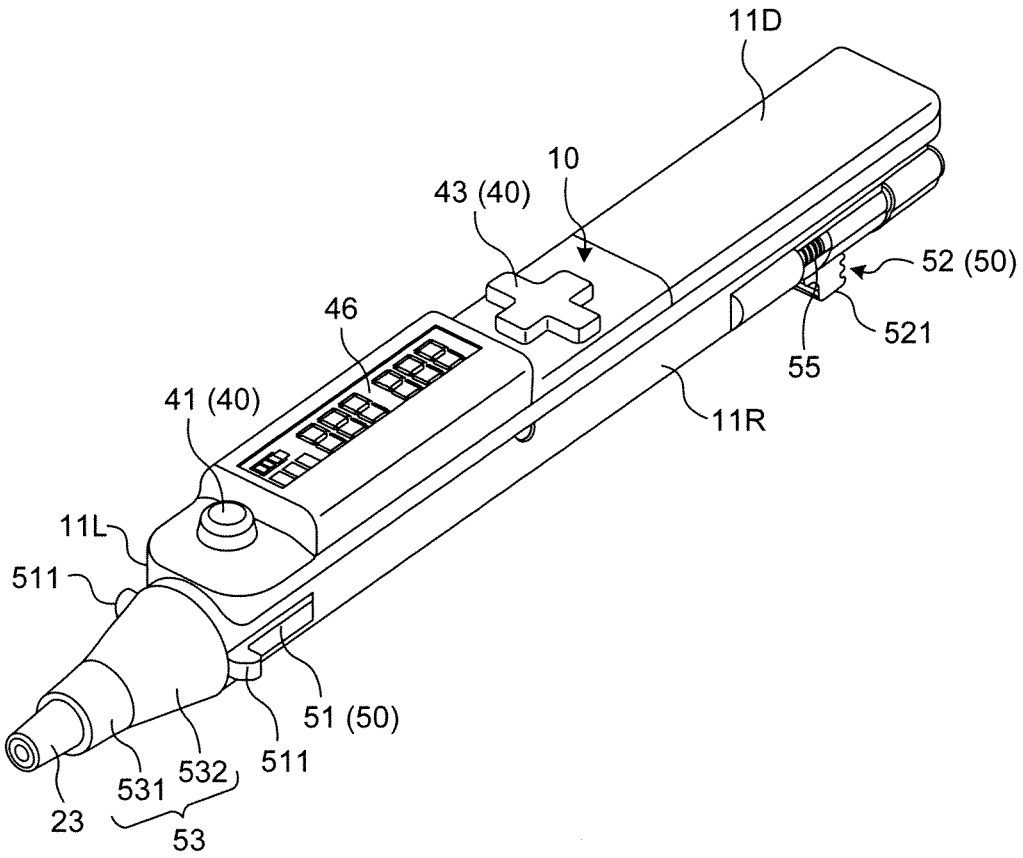
FIG. 1 is a perspective view illustrating a dispensing apparatus according to an embodiment of the invention, in which the apparatus is viewed from a leading end side.
Figure 2:
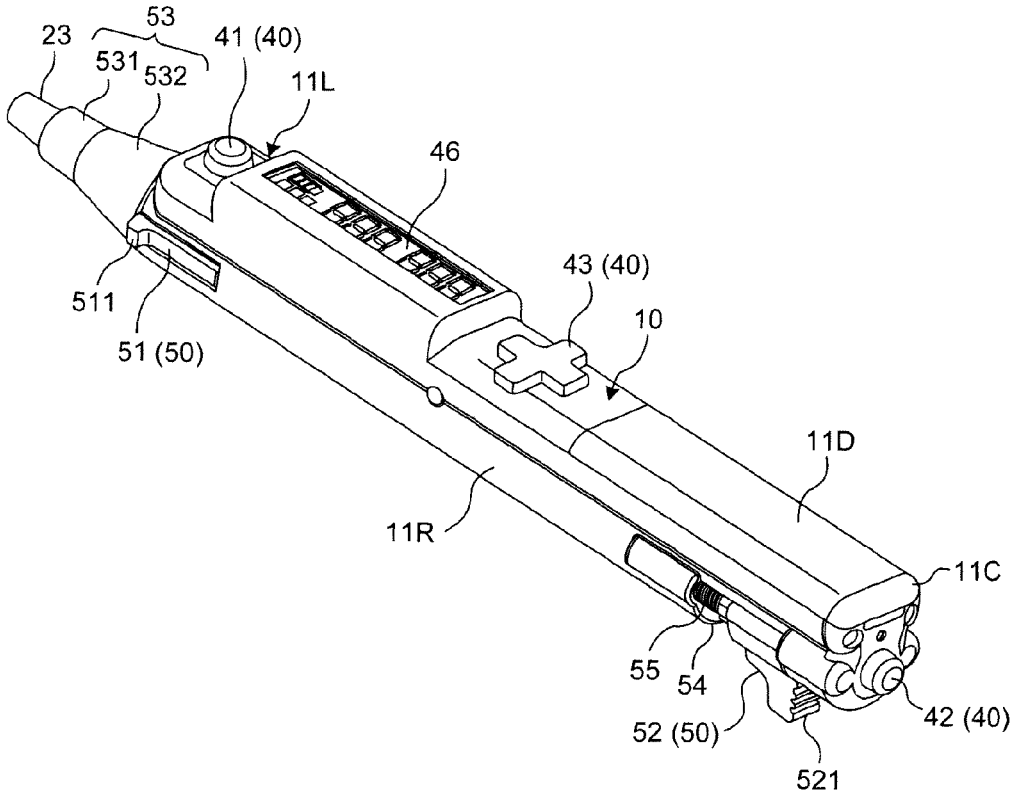
FIG. 2 is a view illustrating the dispensing apparatus according to the embodiment of the invention, in which the apparatus is viewed from a proximal end side.
Figure 3:
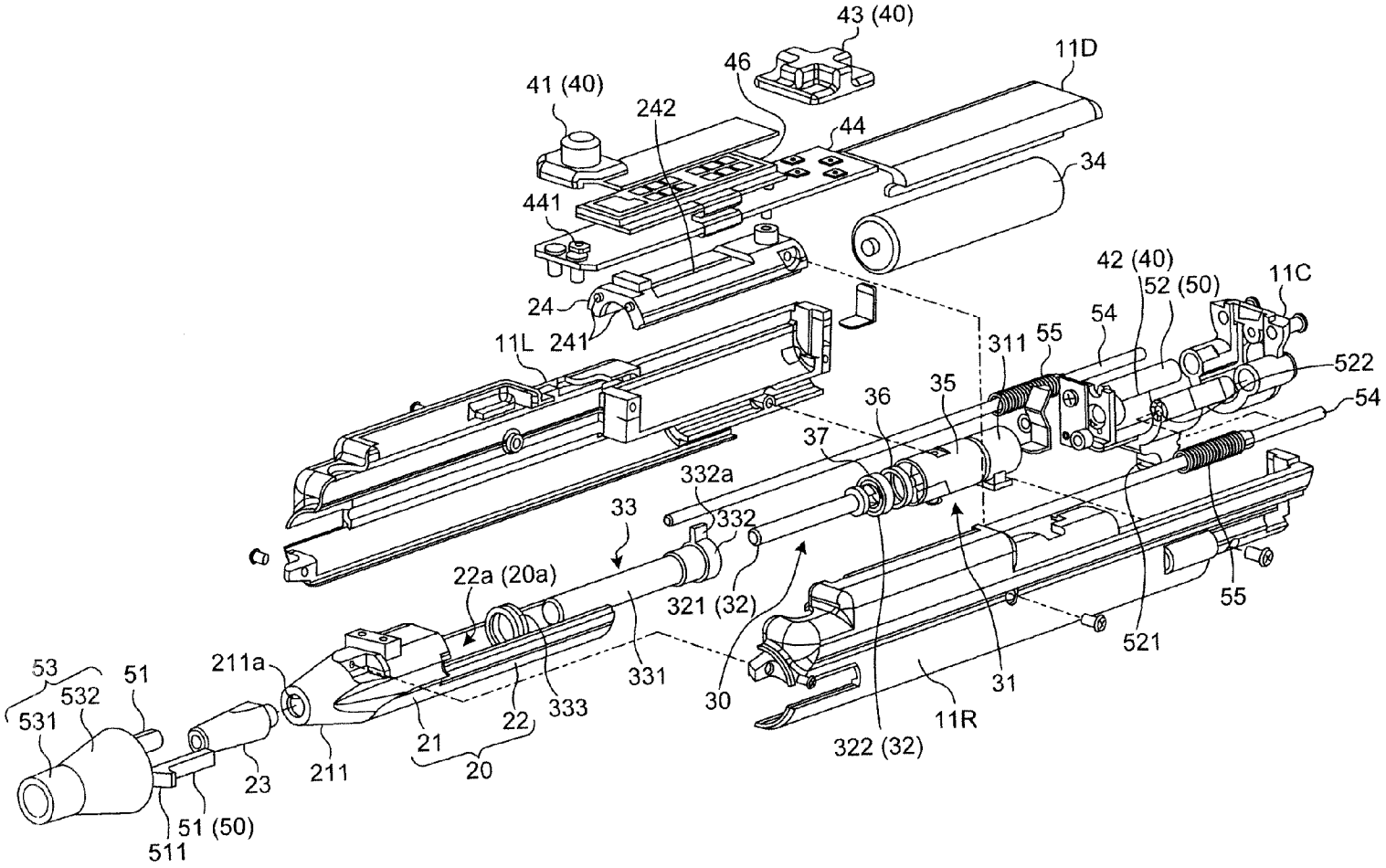
FIG. 3 is an exploded perspective view of the dispensing apparatus according to the embodiment of the invention.

FIGS. 1 to 3 illustrate a dispensing apparatus according to an embodiment of the invention, respectively, FIG. 1 is a perspective view illustrating a case in which the apparatus is viewed from a leading end side, FIG. 2 is a perspective view illustrating a case in which the apparatus is viewed from a proximal end side, and FIG. 3 is an exploded perspective view thereof.

The dispensing apparatus illustrated herein sucks or spouts liquid such as a reagent or a specimen, and is provided with an apparatus main body 10. The apparatus main body 10 is a housing in which an accommodation space is formed by a pair of left and right lateral covers 11L and 11R connected thereto, and a cap 11C of the proximal end side mounted thereto. The lateral covers 11L and 11R have an elongated shape in which a front-back direction becomes a longitudinal direction, respectively, and thus, the apparatus main body 10 has an overall length greater than an overall width.

The apparatus main body 10 is provided with a main body syringe 20, an actuator unit 30, an operation input unit 40, and an ejection mechanism 50. Furthermore, reference numeral 11D in FIGS. 1 to 3 is a cover member that closes a proximal end side opening formed by connecting the lateral covers 11L and 11R.

The main body syringe 20 has a syringe leading end portion 21, and a syringe proximal end portion 22. The syringe leading end portion 21 has a cylindrical leading end hollow portion 21*a* therein (see FIG. 6), and has a tapered shape in which an outer diameter gradually decreases as a leading end region 211 thereof goes toward the leading end. A circular attachment opening 211*a* is formed on the leading end surface of the syringe leading end portion 21, and the attachment opening 211*a* communicates with the leading end hollow portion 21*a*. A nozzle 23 is attached to the leading end surface of the syringe leading end portion 21 in a manner that closes the attachment opening 211*a*. The syringe proximal end portion 22 has a semi-cylindrical shape with opened top and back.

The main body syringe 20 is disposed so as to block the leading end side opening of the apparatus main body 10 in a state in which the syringe proximal end portion 22 is inserted into the accommodation space of the apparatus main body 10, by the syringe leading end portion 21 being attached to the lateral covers 11L and 11R. The leading end region 211 of the syringe leading end portion 21 is exposed from the apparatus main body 10.

A main body cover 24 is attached in a manner that covers the top of the syringe proximal end portion 22 of the main body syringe 20. The main body cover 24 is formed in a semi-cylindrical shape in which the front, the bottom and the back are opened, and has a size enough to cover the top of the syringe proximal end portion 22. The main body cover 24 is attached to the lateral covers 11L and 11R in a state in which a projection 241 provided on the leading end surface is inserted into a recess (not illustrated) provided on the proximal end surface of the syringe leading end portion 21. By attachment of such a main body cover 24, the syringe proximal end portion 22 forms a cylindrical proximal end hollow portion 22*a* between the syringe proximal end portion 22 and the main body cover 24. The proximal end hollow portion 22*a* forms a syringe hollow portion 20*a* (see FIG. 6) so as to communicate with the leading end hollow portion 21*a*.

Figure 4:
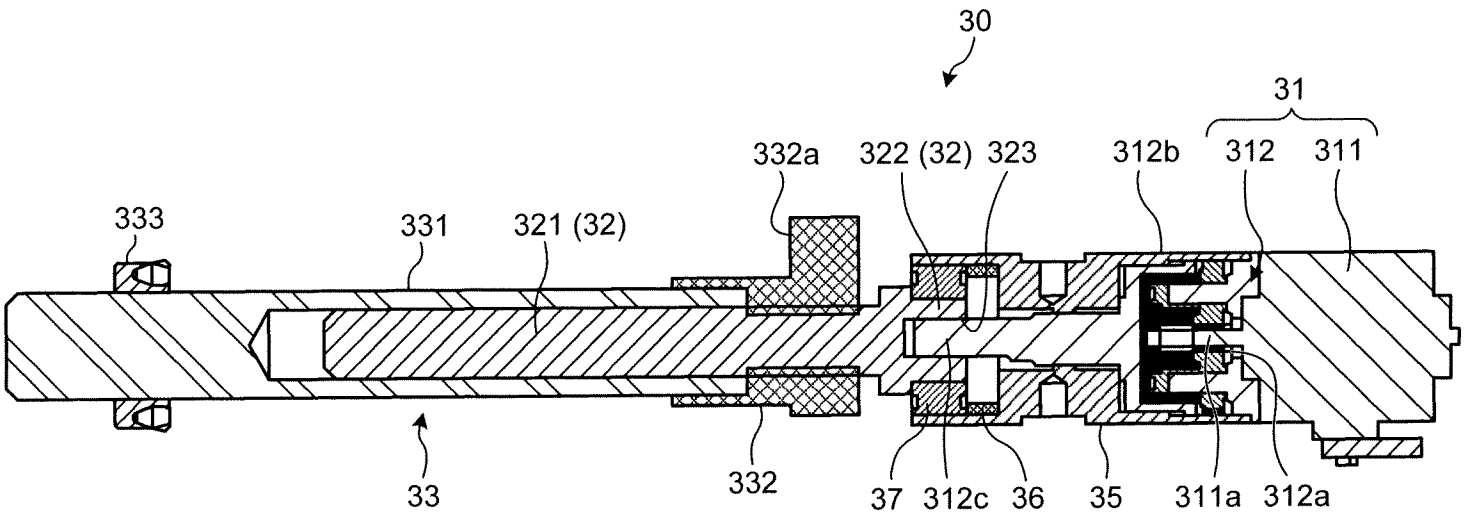
FIG. 4 is a longitudinal cross-sectional view of an actuator unit illustrated in FIG. 3.

FIG. 4 is a longitudinal cross-sectional view of the actuator unit 30 illustrated in FIG. 3. The configuration of the actuator unit 30 will be described while suitably referring to FIG. 4. The actuator unit 30 is configured to include a rotary actuator 31, an output shaft 32, and a piston 33.

The rotary actuator 31 is provided with an electric motor 311 and a reduction gear 312. The electric motor 311 serves as a drive source of the rotary actuator 31, and is driven by power supplied by a cell 34 or the like accommodated in the proximal end side of the accommodation space of the apparatus main body 10, and a command provided from a control circuit to be described below. The electric motor 311 is able to arbitrarily change the direction of rotation depending on the electric conduction direction.

The reduction gear 312 is constituted by a planetary gear mechanism in which a rotary gear 312*a* attached to a rotary shaft 311*a* of the electric motor 311 is configured as a sun gear, and the reduction gear 312 is attached to the main body syringe 20 via an actuator case 35 covering the outer circumferential portion as described below.

Figure 5:
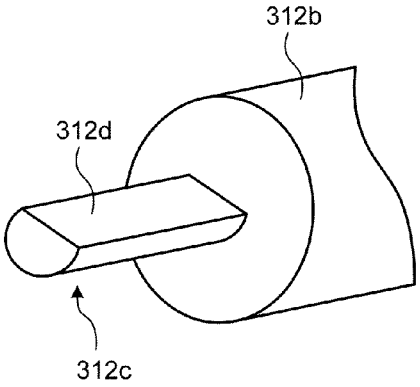
FIG. 5 is a perspective view schematically illustrating a leading end portion of a reduction gear of a rotary actuator that forms the actuator unit illustrated in FIG. 4.

A ring gear 312*b* of the planetary gear mechanism forming the reduction gear 312 has a cylindrical shape with a bottom, forms an integrated drive shaft unit 312*c* in the central portion of the bottom wall outer surface, and is able to rotate with respect to the actuator case 35. The drive shaft unit 312*c* forms the leading end portion of the reduction gear 312, and a planar contact surface 312*d* is formed in a part thereof, as illustrated in FIG. 5.

The actuator case 35 is in the form of a substantially cylindrical shape, and has an extension length enough to cover an outer circumferential region of the drive shaft unit 312*c* that forms the leading end portion of the reduction gear 312. The actuator case 35 covers the outer circumferential portion of the reduction gear 312 such that the central axis thereof matches the central axis of the drive shaft unit 312*c*.

The output shaft 32 has a cylindrical output base portion 321 having screw grooves on the outer circumferential surface, and an output proximal end portion 322 provided in a manner that is connected to the proximal end side of the output base portion 321. The output proximal end portion 322 has a diameter larger than that of the output base portion 321, and an output recess 323 is formed by diverging to a bifurcated shape so that a surface in which parts thereof face each other becomes a plane.

The output shaft 32 causes the leading end of the drive shaft unit 312*c* to relatively enter the output recess 323 by the output proximal end portion 322 being inserted into the actuator case 35 via a spacer 36, and the inserted output proximal end portion 322 is rotatably supported on the leading end portion of the actuator case 35 via a bearing member 37 such as a bearing. At this time, the output shaft 32 is rotatably supported on the actuator case 35 such that the central axis thereof matches the central axis of the drive shaft unit 312*c*.

The piston 33 is configured to include a piston main body 331 and a nut 332. The piston main body 331 has a substantially cylindrical shape with a closed leading end, and the size of the outer diameter thereof is slightly smaller than the inner diameter of the leading end hollow portion 21*a* forming the syringe hollow portion 20*a*. A seal 333 made of an elastic material is wound around the outer circumferential portion, at a location of the leading end side of the piston main body 331. Furthermore, the size of the inner diameter of the piston main body 331 is slightly greater than the outer diameter of the output shaft 32, that is, the outer diameter of the output base portion 321 of the output shaft 32.

The nut 332 is attached to the proximal end portion of the piston main body 331, and is made of a resin material or the like. Screw grooves are formed on the inner circumferential surface of the nut 332, and as illustrated in FIG. 4, the nut 332 is disposed in the output shaft 32 in a state of screwing the screw grooves into the screw grooves of the output shaft 32. A protrusion piece 332*a* extending outward in the radial direction is formed on the outer circumferential portion of the nut 332.

Figure 6:
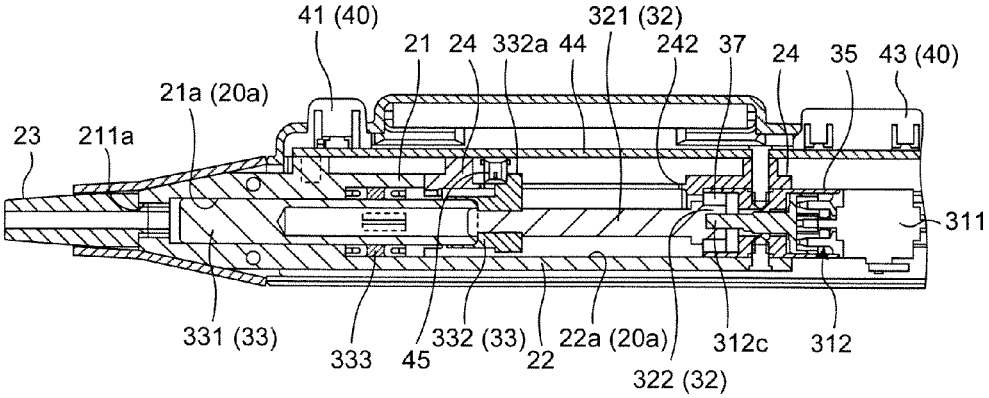
FIG. 6 is a longitudinal cross-sectional view of a main part of the dispensing apparatus illustrated in FIGS. 1 to 3.

As illustrated in FIG. 6, such an actuator unit 30 is attached in a state in which a part of the actuator case 35 is attached to the syringe proximal end portion 22 and the main body cover 24 of the main body syringe 20, that is, a part of the actuator case 35 is housed in the proximal end hollow portion 22*a*. At this time, the leading end portion of the piston 33 forming the actuator unit 30 is inserted into the syringe hollow portion 20*a* of the main body syringe 20, and the protrusion piece 332*a* enters cover grooves 242 formed on the main body cover 24. Furthermore, the piston 33 is biased toward the proximal end side at all times by a biasing means such as a spring (not illustrated).

The operation input unit 40 allows an operator (user) to perform the operation input, and includes a first push button (leading end side push button) 41, a second push button (proximal end side push button) 42, and an operation button 43.

The first push button 41 is provided at a position close to the leading end side of the apparatus main body 10, and the top portion thereof is exposed from the upper surface of the apparatus main body 10. The first push button 41 is intended to turn on a switch 441 attached to a substrate 44 when pressed. Here, the substrate 44 is accommodated in the accommodation space of the apparatus main body 10 in the state of being attached to the main body cover 24, and a control circuit (not illustrated) configured to control the operation of the dispensing apparatus is implemented on the substrate 44. An origin detection sensor 45 configured to detect whether or not the piston 33 is positioned at a standby position is provided on the lower surface of the substrate 44.

The second push button 42 is provided at the proximal end portion of the apparatus main body 10 in a state in which the top portion thereof is exposed from the cap 11C of the apparatus main body 10. The second push button 42 provides the control circuit with a signal indicating that a built-in switch 441 is turned on such when pressed.

The operation button 43 has a cross-shaped top portion, and the top portion is exposed from the upper surface of the apparatus main body 10 of the proximal end side rather than the first push button 41. When any region of the cross-shaped top portion is pressed, the operation button 43 provides the control circuit with an input command assigned to such region. Furthermore, a display unit 46 constituted by, for example, an LCD is provided on the upper surface of the apparatus main body 10 between the operation button 43 and the first push button 41. The display unit 46 displays various types of information on the basis of the instruction provided from the control circuit.

The ejection mechanism 50 is provided with a first ejection lever 51 and a second ejection lever 52. The first ejection lever 51 is formed by a pair of left and right levers, and each lever is provided in a state in which an operation unit 511 protrudes outward from the leading end side notches of the lateral covers 11L and 11R forming the apparatus main body 10. An ejector 53 is attached to the leading end of the first ejection levers 51.

The ejector 53 includes a cylindrical portion 531 having an inner diameter greater than the nozzle 23, and a tapered portion 532 which is continuously provided in the proximal end portion of the cylindrical portion 531, and in which inner and outer diameters thereof are gradually increased as it goes toward the proximal end.

Insertion holes (not illustrated) are formed in the first ejection lever 51 to which the ejector 53 is attached, and the leading end portions of the pair of left and right ejection rods 54 accommodated in the apparatus main body 10 are each inserted into the insertion holes. An ejection spring 55 is wound around the ejection rod 54.

The second ejection lever 52 is provided in a state in which an operation unit 521 protrudes outward from the proximal end side openings of the lateral covers 11L and 11R forming the apparatus main body 10. The second ejection lever 52 is formed with two insertion holes 522, and the proximal end portions of each ejection rod 54 are inserted into the insertion holes 522.

In the dispensing apparatus constructed as described above, as illustrated in FIG. 6, in the initial state in which the power source is supplied, the piston 33 of the actuator unit 30 is positioned at a reference position, and the protrusion piece 332*a* of the nut 332 is positioned in a detectable region of the origin detection sensor 45. Furthermore, although it is not illustrated in drawings, it is assumed that a chip is attached to the nozzle 23 unless otherwise stated.

Figure 7:
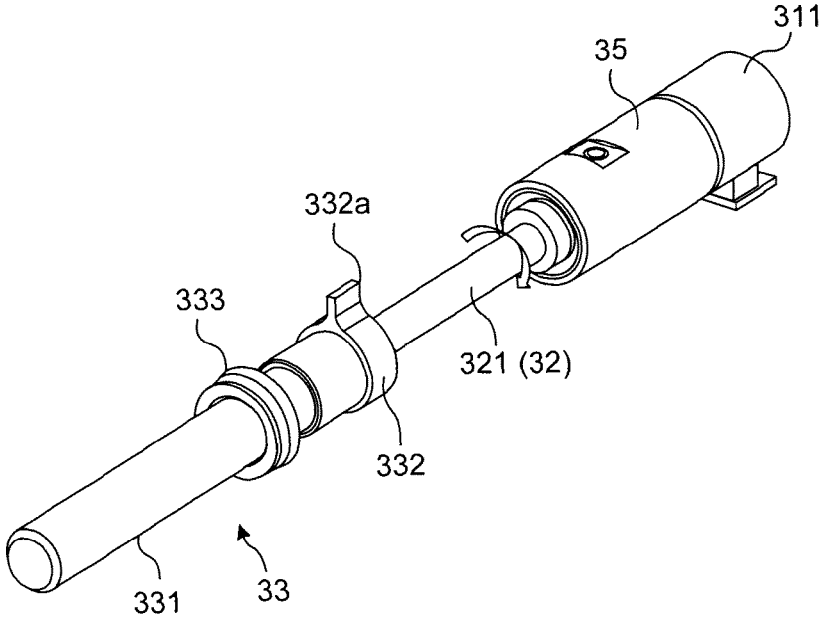
FIG. 7 is a perspective view schematically illustrating the operation of the actuator unit illustrated in FIG. 4.
Figure 8:
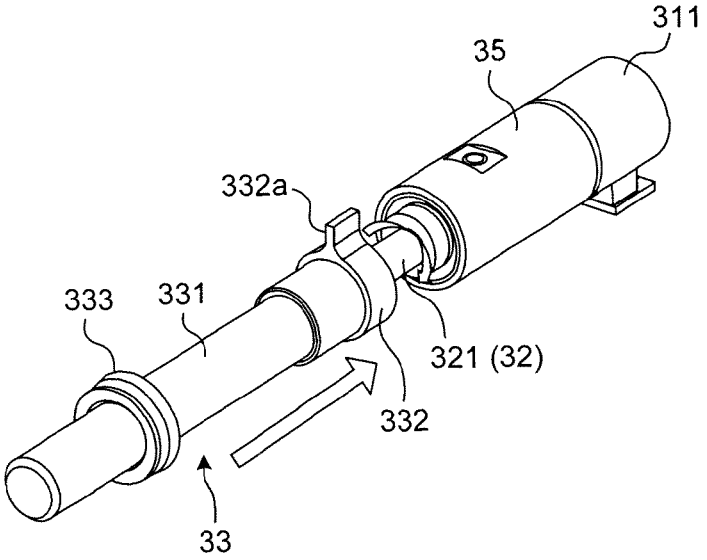
FIG. 8 is a perspective view schematically illustrating the operation of the actuator unit illustrated in FIG. 4.

In the state in which the piston 33 is positioned at the reference position in this manner, when the first push button 41 or the second push button 42 is pressed, the control circuit drives the electric motor 311 by providing the drive command to the electric motor 311. Here, the time at which the control circuit drives the electric motor 311 is a period of time that is enough to suck a predetermined quantity by being input through the operation button 43 or the like. When driving the electric motor 311 in this manner, rotational power suitably reduced in the reduction gear 312 is transmitted to the output shaft 32 via the drive shaft unit 312*c* of the ring gear 312*b*, and as illustrated in FIG. 7, the output shaft 32 rotates about the own axis with respect to the actuator case 35 (the main body syringe 20). When the output shaft 32 rotates with respect to the actuator case 35, as illustrated in FIG. 8, the piston 33 having the nut 332 screwed thereto linearly moves toward the proximal end side along the axial direction of the output shaft 32, while receiving the biasing power of the biasing means. When the piston 33 linearly moves toward the proximal end side, the syringe hollow portion 20*a* of the main body syringe 20 represents a negative pressure, and thus, liquid such as chemical solution is sucked into the chip attached to the nozzle 23.

Figure 9:
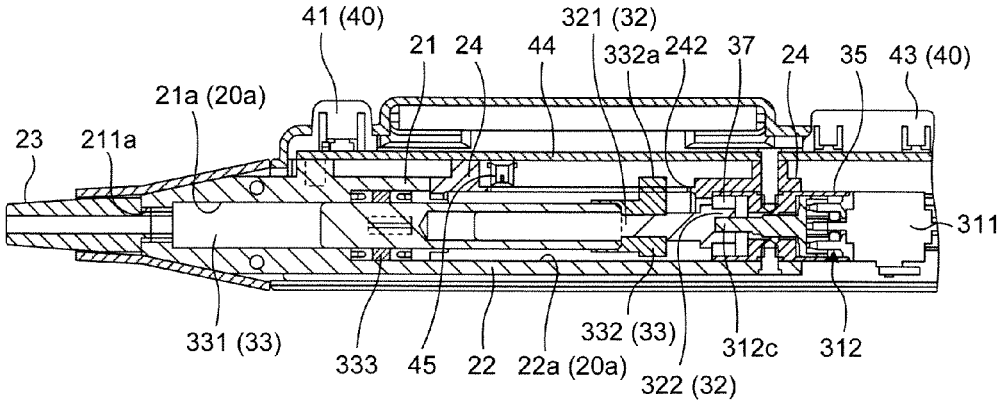
FIG. 9 is a longitudinal cross-sectional view of a main part of the dispensing apparatus illustrated in FIGS. 1 to 3.

Moreover, when the drive of the electric motor 311 using the control circuit is stopped, as illustrated in FIG. 9, the piston 33 is positioned at an advanced position moved to the most proximal end side. The operation button 43 is pressed in a state in which the piston 33 moves to the advanced position, and thus the dispensing apparatus is set in a spouting mode.

When the first push button 41 or the second push button 42 is pressed in the state of being set to the spouting mode as described above, the control circuit drives the electric motor 311 by providing the drive command to the electric motor 311. Furthermore, in the spouting mode, the control circuit rotates the rotary shaft of the electric motor 311 to the opposite side to the case of injection. The time at which the control circuit drives the electric motor 311 is a period of time that is enough to spout a predetermined quantity by being input though the operation button 43 or the like, and a period of time at which a predetermined quantity can be spouted each time the first push button 41 or the second push button 42 is pressed once.

Figure 10:
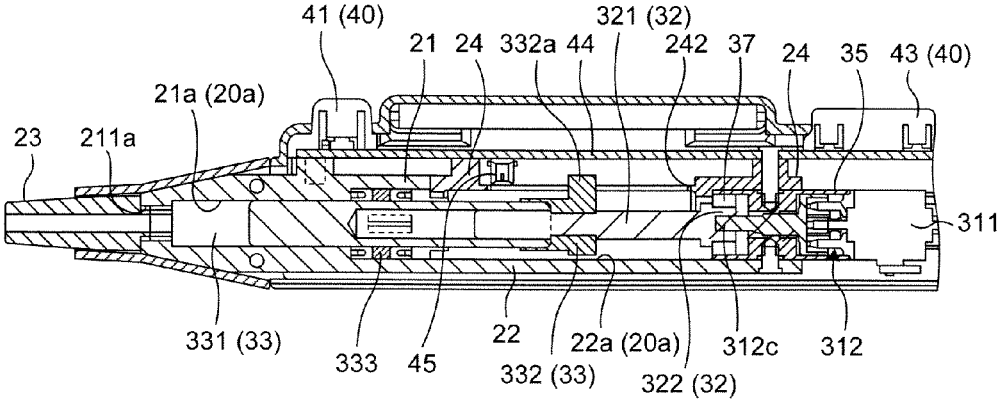
FIG. 10 is a longitudinal cross-sectional view of a main part of the dispensing apparatus illustrated in FIGS. 1 to 3.

When driving the electric motor 311 in this manner, rotational power suitably reduced in the reduction gear 312 is transmitted to the output shaft 32 via the drive shaft unit 312*c* of the ring gear 312*b*, and the output shaft 32 rotates about the own axis with respect to the actuator case 35 (the main body syringe 20). When the output shaft 32 rotates with respect to the actuator case 35, as illustrated in FIG. 10, the piston 33 having the nut 332 screwed thereto linearly moves by a predetermined quantity toward the leading end side along the axial direction of the output shaft 32 against the biasing power of the biasing means. A part (predetermined quantity) of the liquid sucked into the chip is spouted by the linear movement of the piston 33 toward the leading end side.

Each time the first push button 41 or the second push button 42 is pressed, in the dispensing apparatus, the piston 33 linearly moves toward the leading end side by a predetermined quantity to spout a predetermined quantity of liquid, the protrusion piece 332*a* of the nut 332 forming the piston 33 as illustrated in FIG. 6 is positioned at the detectable region of the origin detection sensor 45, and the piston 33 is positioned at the reference position. Thus, the current spouting operation is finished.

As described above, in the dispensing apparatus according to the present embodiment, the actuator case 35 disposed in a manner that covers the outer circumferential portion of the reduction gear 312 forming the rotary actuator 31 is configured so that the own leading end portion rotatably supports the output proximal end portion 322 via the bearing member 37 such that the output proximal end portion 322 of the output shaft 32 is engaged with the drive shaft unit 312*c* in a state capable of transmitting the drive.

Figure 11:
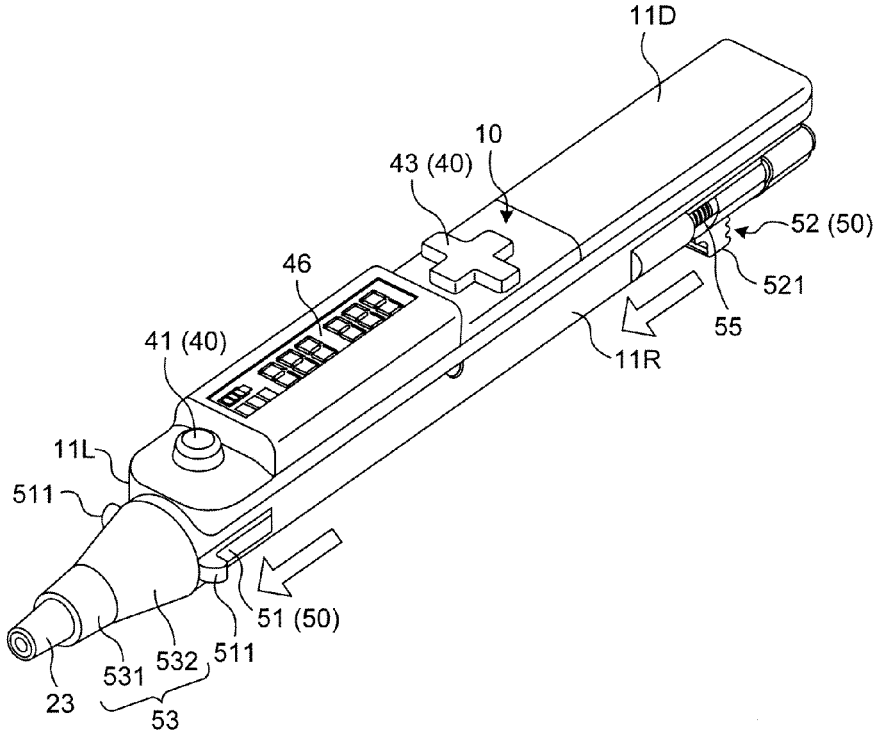
FIG. 11 is a perspective view illustrating a case in which the dispensing apparatus according to the embodiment of the invention is viewed from the leading end side.
Figure 12:
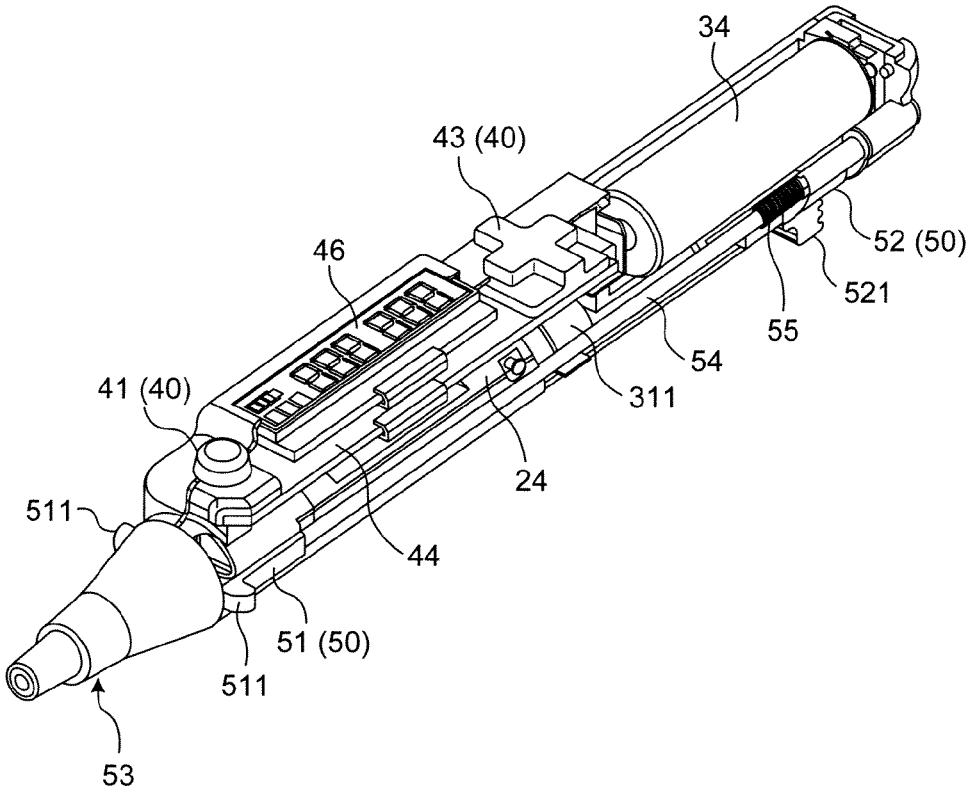
FIG. 12 is a perspective view illustrating an internal structure with a partial cross-section, in a case in which the dispensing apparatus according to the embodiment of the invention is viewed from the leading end side.
Figure 13:
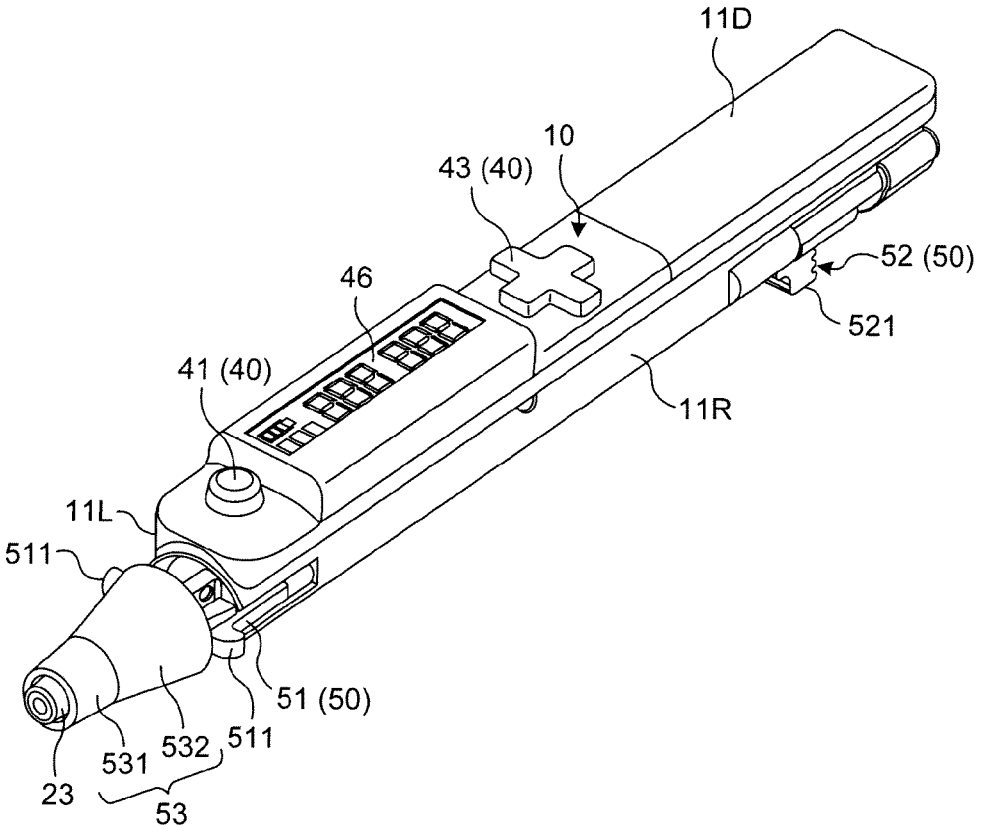
FIG. 13 is a perspective view illustrating a case in which the dispensing apparatus according to the embodiment of the invention is viewed from the leading end side.
Figure 14:
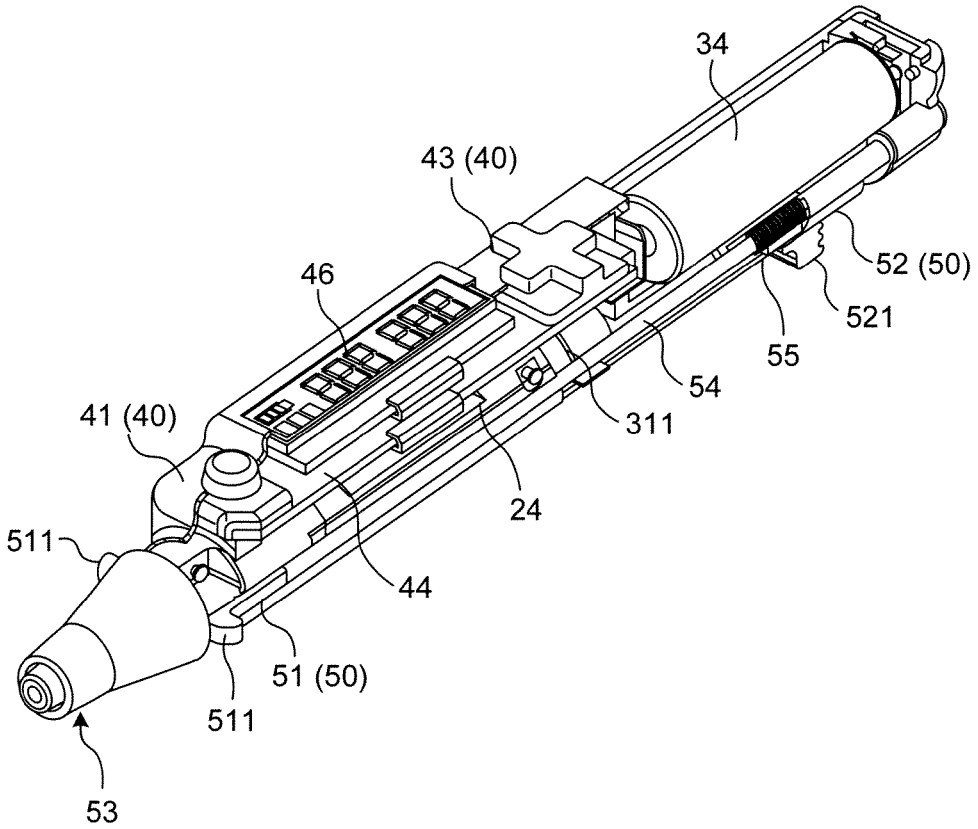
FIG. 14 is a perspective view illustrating an internal structure with a partial cross-section, in a case in which the dispensing apparatus according to the embodiment of the invention is viewed from the leading end side.

Next, the operation for removing the chip attached to the nozzle 23 in the dispensing apparatus will be described. As illustrated in FIGS. 11 and 12, the operation units 511 and 521 of the first ejection lever 51 or the second ejection lever 52 are pressed toward the leading end side, and thus, the first ejection lever 51 or the second ejection lever 52 connected to each other via the ejection rod 54 moves toward the leading end side against the biasing power of the ejection spring 55. Thus, as illustrated in FIGS. 13 and 14, the ejector 53 connected to the first ejection lever 51 relatively moves to the leading end side with respect to the nozzle 23, and thus, the ejector 53 is able to press the chip attached to the nozzle 23 to disengage the chip from the nozzle 23.

As described above, according to the dispensing apparatus of the present embodiment, the leading end portion of the actuator case 35 rotatably supports the output proximal end portion 322 via the bearing member 37 such that the output proximal end portion 322 of the output shaft 32 is engaged with the drive shaft unit 312*c* in a state capable of transmitting the drive. Accordingly, it is not necessary to interpose a plurality of couplings as in the related art, it is possible to minimize the components interposed between the rotary actuator 31 and the piston 33, and it is possible to suppress the power loss generated until power of the rotary actuator 31 is transmitted to the piston 33 to a minimum level. In addition, even if the rotary actuator 31, the output shaft 32, and the piston 33 are disposed so as to be aligned on the same central axis, it is possible to sufficiently shorten the overall length of the entire apparatus. Therefore, it is possible to improve the power transmission efficiency, and to shorten the overall length of the entire apparatus.

In particular, the actuator case 35 covers the outer circumferential portion of the reduction gear 312 such that the own central axis matches the central axis of the drive shaft unit 312*c*, and the actuator case 35 rotatably supports the output proximal end portion 322 via the bearing member 37 such that the central axis of the output shaft 32 matches the central axis of the drive shaft unit 312*c*. Accordingly, the actuator case 35 positions the output shaft 32, and is able to improve the assembly efficiency, while achieving a high degree of axial accuracy.

Furthermore, according to the dispensing apparatus described above, since there is no need for a plurality of couplings or the like as in the related art, it is possible to reduce the number of parts and to reduce the manufacturing cost.

Furthermore, according to the dispensing apparatus described above, the first push button 41 forming the operation input unit is disposed at a position close to the leading end side of the apparatus main body 10, and the second push button 42 is disposed at the proximal end side of the apparatus main body 10. Accordingly, when pressing the second push button 42, the user (operator) is able to hold the dispensing apparatus, by a gripping method, such as being performed in the dispensing apparatus of the related art, and in the case of pressing the first push button 41, the user is able to hold the dispensing apparatus by a gripping method, such as pressing the first push button 41 with an index finger, that is, for example, a gripping method such as gripping a pen, while shortening the overall length of the entire apparatus, as described above, and as a result, the user can select the gripping method.

Furthermore, according to the dispensing apparatus, the ejection mechanism 50 engages and disengages the chip attached to the nozzle 23 from the nozzle 23, when the first ejection lever 51 disposed at the position close to the leading end portion of the apparatus main body 10 or the second ejection lever 52 disposed at the proximal end portion of the apparatus main body 10 is operated. Accordingly, when operating the second ejection lever 52, the user (operator) is able to hold the dispensing apparatus by the gripping method, such as being performed in the dispensing apparatus of the related art, and when pressing the first ejection lever 51, the user is able to hold the dispensing apparatus by the gripping method such as, for example, gripping a pen, while shortening the overall length of the entire apparatus as described, and as a result, the user can select the gripping method.

In the embodiment described above, the cell 34 was assumed to be a power source, but in the invention, a battery other than the cell may be mounted as a power supply.

According to the embodiment of the present invention, in an actuator case disposed so as to cover an outer circumferential portion of a reduction gear forming a rotary actuator, a leading end portion thereof rotatably supports a proximal end portion via a bearing member such that a proximal end portion of the output shaft is engaged with a leading end portion of the reduction gear in a state capable of transmitting the drive. Accordingly, it is not necessary to interpose the plurality of couplings or the like as in the related art, it is possible to minimize elements interposed between the rotary actuator and a piston, and it is possible to suppress the power loss generated until power of the rotary actuator is transmitted to the piston to a minimum level. In addition, even if the rotary actuator, the output shaft, and the piston are disposed so as to be aligned on the same central axis, it is possible to sufficiently shorten the overall length of the entire apparatus. Therefore, there is an effect that it is possible to improve the power transmission efficiency, and to shorten the overall length of the entire apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A dispensing apparatus comprising:

an output shaft having screw grooves on an outer circumferential surface;

a rotary actuator including a reduction gear and configured to rotate the output shaft around an axis of the output shaft;

a piston screwed into the screw grooves of the output shaft and configured to move back and forth along an axial direction of the output shaft by drive of the rotary actuator;

a nozzle disposed at a leading end of the dispensing apparatus and configured to suck and spout liquid in accordance with the back and forth movement of the piston; and an actuator case configured to cover an outer circumferential portion of the reduction gear, and configured to support a proximal end portion of the output shaft by a leading end portion of the actuator case such that the proximal end portion of the output shaft is engaged with a leading end portion of the reduction gear in a state capable of transmitting the drive, wherein the reduction gear is equipped with a planetary gear mechanism having a cylindrical ring gear with a bottom, and has a drive shaft unit which forms the leading end portion of the reduction gear by protruding toward the leading end side in a center portion of a bottom wall outer surface of the ring gear, and is partially formed with a planar contact surface, when the drive shaft unit relatively enters an output recess formed in the proximal end portion of the output shaft and the drive shaft unit rotates around an axis, the actuator case rotatably supports the proximal end portion so as to enable to transmit the drive to the output shaft by the contact surface coming into contact with an inner wall surface of the output recess, and the output recess is formed by diverging to a bifurcated shape so that a surface in which parts thereof face each other becomes a plane.

2. The dispensing apparatus according to claim 1, further comprising:

a housing that accommodates each component such that the axial direction of the output shaft matches a longitudinal direction of the housing, and has an overall length greater than an overall width; and a leading end side push button that is disposed at a location close to the leading end side of the housing, and forms an operation input unit for driving the rotary actuator.

3. The dispensing apparatus according to claim 2, wherein the operation input unit includes the leading end side push button, and a proximal end side push button disposed at a predetermined position of the proximal end side of the housing, and when one of the leading end side push button and the proximal end side push button is pressed, the operation input unit drives the rotary actuator.

4. The dispensing apparatus according to claim 2, further comprising:

an ejection mechanism that engages and disengages a pipette tip attached to the nozzle from the nozzle when a first ejection lever disposed at a location close to the leading end side of the housing or a second ejection lever disposed at a proximal end region of the housing is operated.

5. The dispensing apparatus according to claim 3, further comprising:

an ejection mechanism that engages and disengages a pipette tip attached to the nozzle from the nozzle when a first ejection lever disposed at a location close to the leading end side of the housing or a second ejection lever disposed at a proximal end region of the housing is operated.

6. The dispensing apparatus according to claim 1, further comprising:

a housing that accommodates each component such that the axial direction of the output shaft matches a longitudinal direction of the housing, and has an overall length greater than an overall width; and a leading end side push button that is disposed at a location close to the leading end side of the housing, and forms an operation input unit for driving the rotary actuator.

7. The dispensing apparatus according to claim 6, wherein the operation input unit includes the leading end side push button, and a proximal end side push button disposed at a predetermined position of the proximal end side of the housing, and when one of the leading end side push button and the proximal end side push button is pressed, the operation input unit drives the rotary actuator.

8. The dispensing apparatus according to claim 6, further comprising:

an ejection mechanism that engages and disengages a pipette tip attached to the nozzle from the nozzle when a first ejection lever disposed at a location close to the leading end side of the housing or a second ejection lever disposed at a proximal end region of the housing is operated.

9. The dispensing apparatus according to claim 7, further comprising:

an ejection mechanism that engages and disengages a pipette tip attached to the nozzle from the nozzle when a first ejection lever disposed at a location close to the leading end side of the housing or a second ejection lever disposed at a proximal end region of the housing is operated.

* * * * *